US006874474B2

(12) United States Patent
Fuchs

(10) Patent No.: US 6,874,474 B2
(45) Date of Patent: Apr. 5, 2005

(54) SINGLE-DIE INJECTION PUMP FOR A COMMON RAIL FUEL INJECTION SYSTEM

(75) Inventor: Walter Fuchs, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/297,427

(22) PCT Filed: Apr. 5, 2002

(86) PCT No.: PCT/DE02/01237

§ 371 (c)(1),
(2), (4) Date: Jul. 21, 2003

(87) PCT Pub. No.: WO02/081920

PCT Pub. Date: Oct. 17, 2002

(65) Prior Publication Data

US 2004/0013538 A1 Jan. 22, 2004

(30) Foreign Application Priority Data

Apr. 6, 2001 (DE) ..... 101 17 093
Aug. 4, 2001 (DE) ..... 101 38 362

(51) Int. Cl.[7] ..... F02M 37/04
(52) U.S. Cl. ..... 123/446; 123/495

(58) Field of Search ..... 123/446, 495–496

(56) References Cited

U.S. PATENT DOCUMENTS 5,058,553 A * 10/1991 Kondo et al. ..... 123/456
6,135,090 A * 10/2000 Kawachi et al. ..... 123/446
6,149,073 A * 11/2000 Hickey et al. ..... 239/89
6,209,525 B1 * 4/2001 Konishi et al. ..... 123/467
6,318,343 B1 * 11/2001 Nakagawa et al. ..... 123/500

FOREIGN PATENT DOCUMENTS

DE 196 12 413 A1 10/1997
DE 199 56 267 A1 5/2000
EP 0 375 944 A2 7/1990

* cited by examiner

*Primary Examiner*—Thomas Moulis
(74) *Attorney, Agent, or Firm*—Ronald E. Greigg

(57) ABSTRACT

A single-die injection pump for high-speed internal combustion engines which, because of its compact design and good volumetric efficiency, in conjunction with a high oscillation frequency of the piston, has a pumping quantity comparable to a multiple-die injection pump, without causing excessively high peak torque values in the drive of the single-die injection pump.

14 Claims, 3 Drawing Sheets

SINGLE-DIE INJECTION PUMP FOR A COMMON RAIL FUEL INJECTION SYSTEM

CROSS-REFERENCE TO RELATED APPLICATIONS

This application is a 35 USC 371 application of PCT/DE 02/01237 filed on Apr. 5, 2002.

BACKGROUND OF THE INVENTION

1. Field of the Invention

The invention relates to an injection pump for a common rail fuel injection system of an internal combustion engine, having a pump cylinder, disposed in a housing, having a piston oscillating in the pump cylinder, wherein the pressure of the fuel aspirated from a fuel inlet into the pump cylinder is increased by the piston, and having a quantity control valve, wherein the quantity control valve has a directly triggered control piston integrated with the housing, and the quantity control valve controls the pumping flow of the piston into an outlet or a high-pressure bore communicating with a common rail.

2. Description of the Prior Art

The injection pump known from German Published, Nonexamined Patent Application DE-OS 42 21 921 A1 is suitable for use in internal combustion engines with more than one cylinder only if it has a number of pump cylinders corresponding to the number of engine cylinders. With the number of pump cylinders, the production costs also rise.

In so-called common rail fuel injection systems, there is in principle the possibility of decoupling the number of engine cylinders from the number of pump cylinders in the high-pressure fuel pump. Because of the large temporary pumping quantity and the resultant peak torque value, and the previously unsolved problem of filling the pump cylinder in a very short time, until now single-die injection pumps were not used to supply fuel in common rails of internal combustion engines that have more than one cylinder.

The object of the invention is to provide a single-die injection pump for internal combustion engines with more than one cylinder that are equipped with a common rail fuel injection system.

The object is attained according to the invention by an injection pump for a common rail fuel injection system of an internal combustion engine, having a pump cylinder, disposed in a housing, having a piston oscillating in the pump cylinder, wherein the pressure of the fuel aspirated from a fuel inlet into the pump cylinder is increased by the piston, and having a quantity control valve, wherein the quantity control valve has a directly triggered control piston integrated with the housing, and the quantity control valve controls the pumping flow of the piston into an outlet or a high-pressure bore communicating with a common rail, and in which the piston oscillates at a frequency greater than or equal to half the crankshaft rpm of the engine. Alternatively, the single-die pump can also be controlled by an intake throttle valve.

SUMMARY OF THE INVENTION

Because of its compact design, the injection pump of the invention has a small idle volume, and so the efficiency of the injection pump is improved. Because of the good efficiency of the injection pump, the piston can be made quite small, and so its oscillation can be achieved at a frequency greater than half the crankshaft rpm. As a result, it is possible for the nonuniformity of the pumping quantity over time to be made synchronous with the injection. Moreover, for the same pumping capacity, it can be attained that the peak torque values for driving the injection pump of the invention are reduced. Because of the small piston diameter, leakage between the pump cylinder and the piston is reduced, thus improving the volumetric efficiency and hence also the overall efficiency.

Moreover, because of the small surfaces, the housing deforms in response to the pressure forces and thermally dictated stresses to only a very slight extent, which makes a reduced cold-operation play possible, thus further improving the efficiency of the injection pump of the invention.

By the inventive combination of a plurality of characteristics, it has been successfully possible to furnish a functional single-die injection pump for internal combustion engines with a common rail fuel injection system, which because of the advantages mentioned is very compact in size and can also be produced economically, because of the small number of components.

In a variant of the invention, the piston is actuated by a camshaft or by a cam disk having at least one cam, so that the oscillation frequency of the piston can be increased in a simple way. Depending on which shaft of the engine (camshaft, compensation shaft, crankshaft) drives the injection pump of the invention, the number of cams can be selected to suit the demand for pumped fuel.

In a further feature of the invention, the speed of the piston during the intake stroke is less than during the pumping stroke, so that cavitation phenomena during the intake stroke are maximally avoided.

In another feature of the invention, the pump cylinder is embodied as a blind bore, so that the idle volume and leakage losses are further reduced. The quantity regulation of the injection pump, by varying the prestroke of the piston, also contributes to reducing the idle volume. By means of this quantity regulation, the piston always pumps up to top dead center (TDC), so that the idle volume becomes minimal.

In another feature of the invention, it is provided that the outlet can be sealed off by a sealing seat between the housing and the control piston, and that the diameter of the sealing seat is less than the diameter of a receiving bore in the housing for the control piston, so that the opening motion of the control piston is reinforced by the fuel that is under pressure. It is also possible that the opening motion of the quantity control valve is reinforced by a spring, so that a shortening of the opening times and improved starting performance of the engine are achieved. Moreover, the pressure forces on the low-pressure side can be largely compensated for, in a variant, by means of two piston faces of approximately equal size.

Further variants of the invention provide that the longitudinal axis of the control piston forms an angle of 90° with the longitudinal axis of the piston, and/or that a pressure relief chamber acting as a low-pressure reservoir is provided in the outlet, so that an especially compact design with a correspondingly slight idle volume is achieved, and that the low-pressure reservoir reinforces the filling of the pump cylinder during the intake stroke. This provision also prevents cavitation.

By the use of ceramic for the piston and a possibly present tappet roller, the forces of inertia can be reduced, thus reducing the load on the injection pump. Moreover, because of the good wear and deformation performance of ceramic, the play between piston and cylinder can be decreased, thus further increasing the volumetric efficiency.

In a further feature of the invention, it is provided that a common rail is integrated with the housing, so that the idle volume is reduced still further.

In still another feature of the invention, the pumping stroke of the injection pump is phase-offset in a way synchronized with injection at the instant of injection of the engine. Depending on how great a phase offset is selected, any pressure surges that may occur in a high-pressure region of the injection pump can be utilized to build up the highest possible injection pressure, or else the injection takes place at an instant when there are no pressure surges, or pressure surges of only a slight extent. In the second variant, the fuel metering precision upon injection is improved.

BRIEF DESCRIPTION OF THE DRAWINGS

Further advantages and advantageous features of the invention can be learned from the detailed description contained herein below, taken in conjunction with the drawings, in which.

DESCRIPTION OF THE PREFERRED EMBODIMENTS

Figure 1:
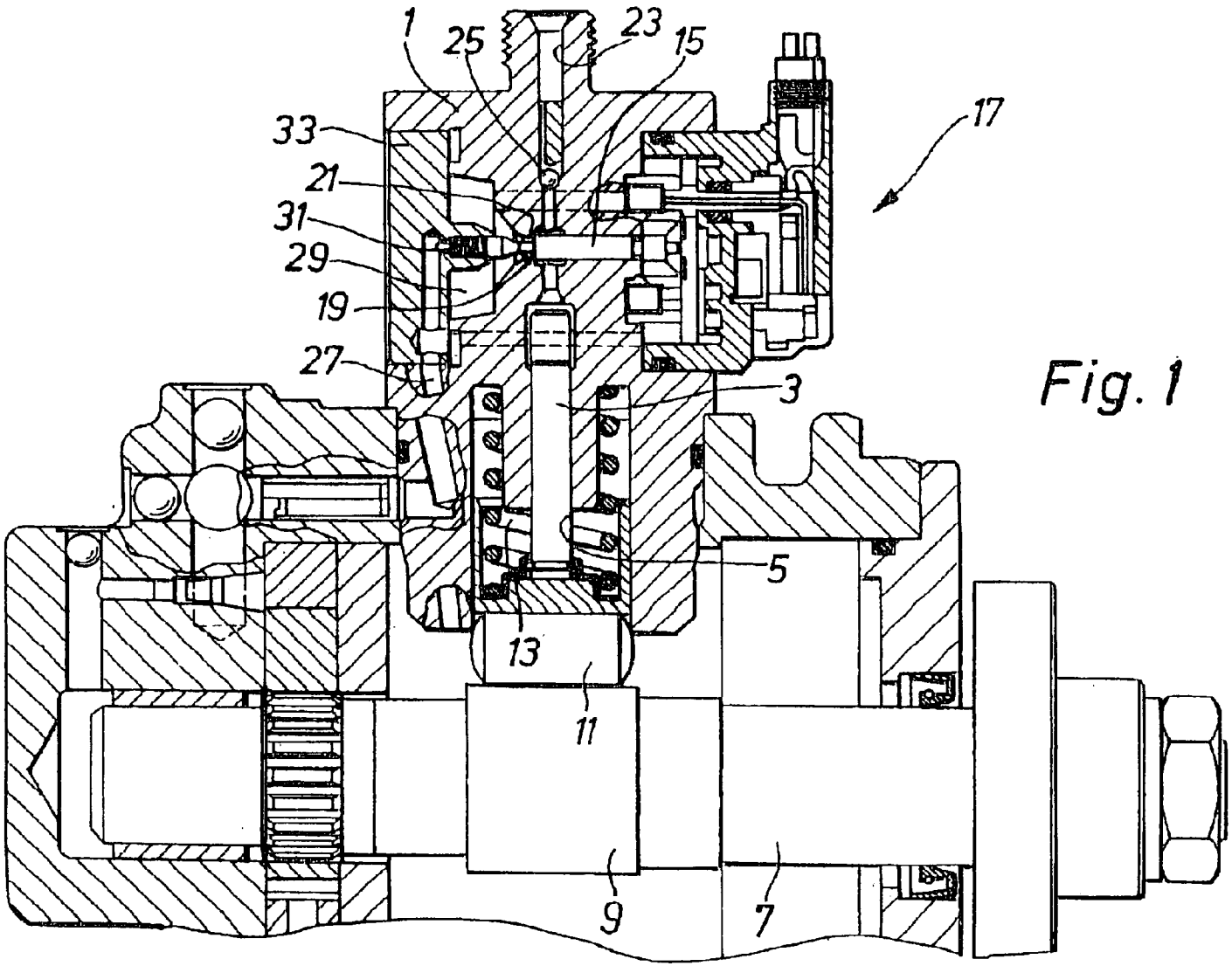
FIG. 1 is a sectional view of a first exemplary embodiment of a single-die injection pump of the invention.

FIG. 1 shows a first exemplary embodiment of a single-die injection pump of the invention. In a housing 1, a piston 3 is guided by a pump cylinder 5. The piston 3 is driven by a camshaft 7. An eccentric portion 9 of the camshaft 7 acts via a tappet roller 11 on the piston 3. The eccentric portion is a cam, in terms of the invention. However, the cams can also have other geometries than an eccentrically disposed circle. The piston 3 is pressed against the tappet roller 11 via a restoring spring 13 represented only symbolically.

Above the pump cylinder 5 in the housing 1, a control piston 15 of a quantity control valve 17 embodied as a magnet valve is disposed perpendicular to the longitudinal axis of the pump cylinder 5. The control piston 5 has a shoulder 19, which together with a correspondingly embodied heel 21 forms a sealing seat. When the quantity control valve 17 is closed, the shoulder 19 rests on the heel 21, and the fuel pumped by the piston 3 is pumped into a high-pressure bare 23. This high-pressure bore 23 communicates, via a high-pressure line, not shown, with the common rail, also not shown, of the fuel injection system. A check valve 25 in the high-pressure bore 23 prevents fuel from the common rail from flowing back into the injection pump. The piston face closes off the low-pressure chamber 29 and largely compensates for the low-pressure-side forces on the piston.

When the quantity control valve 17 is open, the piston 3 pumps into the low-pressure chamber 29, or during the intake stroke of the injection pump aspirates fuel, via the fuel inlet 27, from the low-pressure chamber 29 into the pump cylinder 5. When the quantity control valve 17 is closed during the pumping stroke, a pressure builds up in the pump cylinder 5 that leads to opening of the check valve 25 and then enables the pumping of fuel from the pump cylinder 5 into the common rail, not shown. The earlier the quantity control valve 17 closes, the greater is the fuel quantity pumped into the common rail per pumping stroke of the piston 3. By the choice of the instant of closure of the quantity control valve 17, the quantity pumped per pumping stroke can be controlled between 0 and 100% of the pump displacement.

Because of the extremely compact, rigid design of the injection pump and the small idle volumes of the injection pump, this pump has good efficiency. As a result, the piston 3 can be made smaller, which further reduces the leakage loss between the pump cylinder 5 and the piston 3. Moreover, because of the small displacement of the piston 3, only a slight quantity of fuel has to be pumped out of the fuel chamber 29 into the pump cylinder 5 during the intake stroke, which reduces the incidence of cavitation. The tendency to cavitation can be further reduced by designing the eccentric portion 9 of the camshaft 7, shown in FIG. 1, accordingly. If the speed of the piston 3 during the intake stroke is less than during the pumping stroke, then the tendency to cavitation upon aspiration of fuel decreases.

Because of the small dimensions of the piston 3 and its small mass, the allowable Hertzian stress between the tappet roller 11 and the eccentric portion 9 of the camshaft 7 is not exceeded, even at major accelerations of the piston 3 and high pressures during the pumping stroke.

Figure 2:
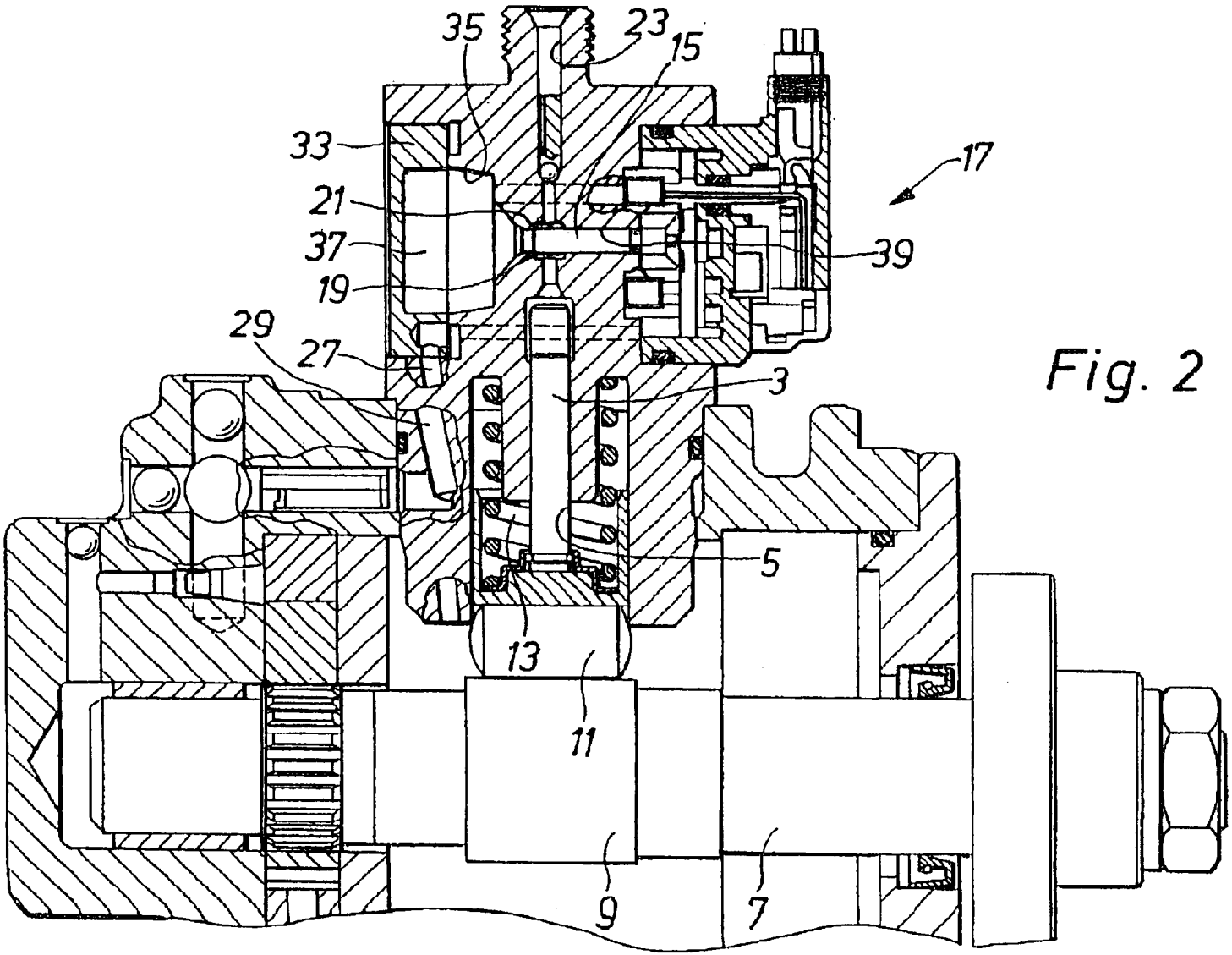
FIG. 2, a second exemplary embodiment of a single-die injection pump of the invention.

In the exemplary embodiment shown in FIG. 1, the control piston 15 is reinforced by a compression spring 31, which is braced against the cap 33 of the housing 1. In the second exemplary embodiment in FIG. 2, there is no compression spring 31, and the cap 33 is embodied partly as a diaphragm. Directly behind the sealing seat formed by the shoulder 19 and heel 21, there is a recess 35 in the housing 1, which together with the suitably designed cap 33 forms a pressure relief chamber 37. The pressure energy stored in the pressure relief chamber 37 during the prefeed stroke reinforces the aspiration of fuel from the fuel chamber 29 into the pump cylinder 5 and thus reduces the tendency to cavitation during the intake stroke. If the diameter of the sealing seat is less than the diameter of a receiving bore 39 in the housing 1 for the control piston 15, then the opening motion of the control piston 15 is additionally reinforced by the hydraulic forces. Because of the high oscillation frequency of the piston 3, the mean flow speed of the fuel during the intake stroke is less than if the same fuel quantity is aspirated in an intake stroke over two camshaft revolutions each.

Figure 3:
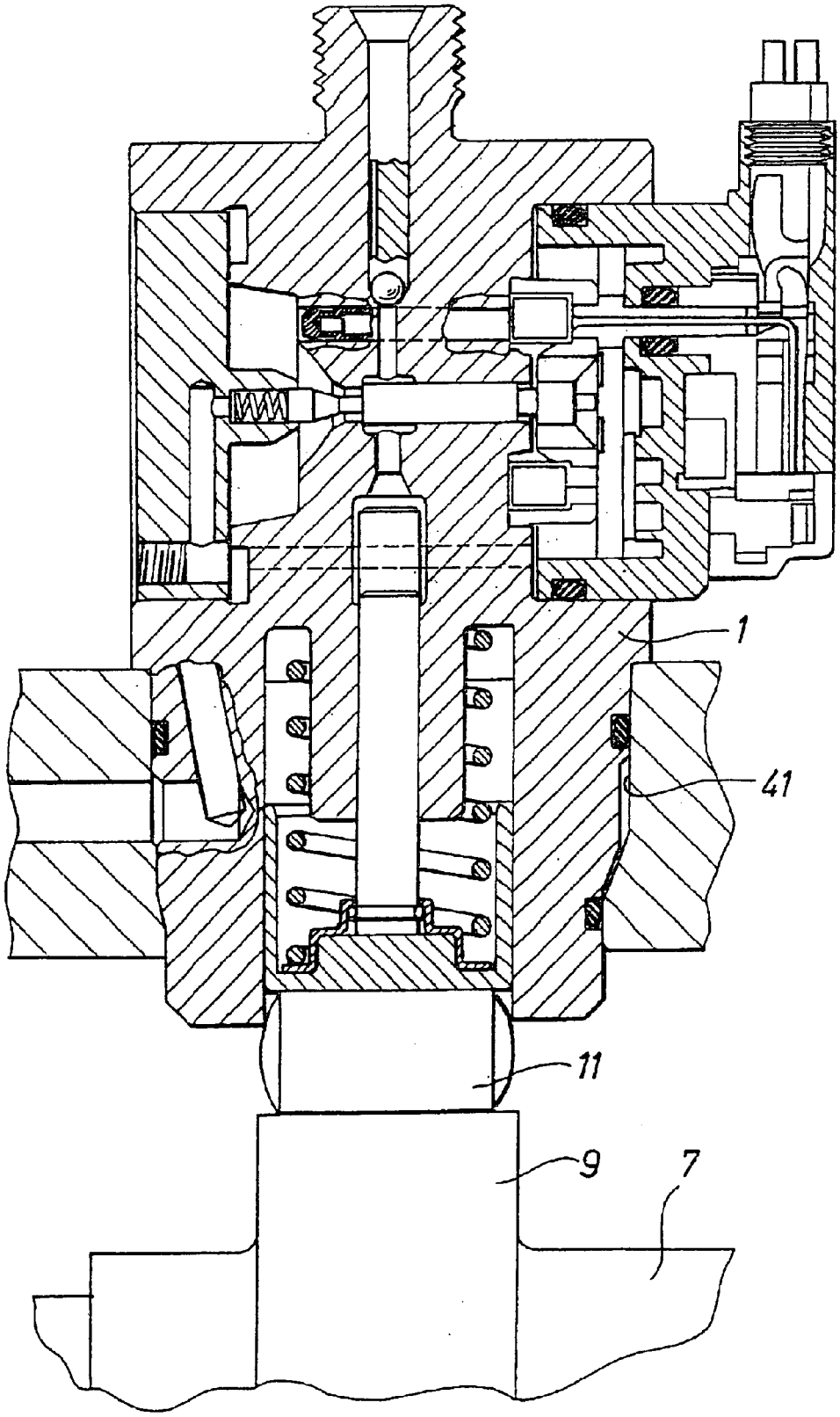
FIG. 3, a third exemplary embodiment of a single-die injection pump of the invention.

In FIG. 3, a third exemplary embodiment of an injection pump of the invention is shown. As in the second exemplary embodiment, identical components are identified by the same reference numerals, and the above description applies accordingly. In this injection pump, the camshaft 7 is part of the engine, and the housing 1 is inserted directly into a suitable recess 41 of the engine. The result is a very compact design. Moreover, if the camshaft 7 is part of a shaft that is present anyway in the engine, the effort of production is less, making for less expense. This drive mechanism, which has a positive effect on production costs.

All the characteristics disclosed in the drawing, its description and the claims can be essential to the invention both individually and in arbitrary combination with one another.

The foregoing relates to preferred exemplary embodiments of the invention, it being understood that other variants and embodiments thereof are possible within the spirit and scope of the invention, the latter being defined by the appended claims.

What is claimed is:

1. An injection pump for a common rail fuel injection system of an internal combustion engine, the pump comprising a pump cylinder (5), disposed in a housing (1), a piston (3) oscillating in the pump cylinder (5), wherein the pressure of the fuel aspirated from a fuel inlet chamber (29) into the pump cylinder (5) is increased by the piston (3), and a quantity control valve (17), wherein the quantity control valve (17) has a directly triggered control piston (15) integrated with the housing (1), the quantity control valve (17) controlling the pumping flow of the piston (3) into a fuel inlet (27) or into a high-pressure bore (23) communicating with a common rail, and the piston (3) oscillating at a frequency greater than or equal to half the crankshaft rpm of the engine during operation, further comprising a sealing seat between the housing (1) and the control piston (15) sealing off the communication between the fuel inlet (27) and the pump cylinder (5), the diameter of the sealing seat being less than the diameter of a receiving bore (39) in the housing (1) for the control piston (15).

2. The injection pump of claim 1, wherein the piston (3) is actuated by a camshaft (7) or by a cam disk having at least one cam.

3. The injection pump of claim 2, wherein the speed of the piston (3) during the intake stroke is less than during the pumping stroke.

4. The injection pump of claim 1, wherein the pump cylinder (5) is embodied as a blind bore.

5. The injection pump of claim 1, wherein the quantity regulation of the injection pump is effected by varying the prestroke of the piston (3).

6. The injection pump of claim 1, further comprising a compression spring (31) reinforcing the opening motion of the quantity control valve (17).

7. The injection pump of claim 1, wherein the longitudinal axis of the control piston (15) forms an angle of 90° with the longitudinal axis of the piston (3).

8. The injection pump of claim 1, further comprising a pressure relief chamber (37) acting as a low-pressure reservoir in the fuel inlet (27).

9. The injection pump of claim 1, wherein the piston (3) and if present a tappet roller (11) are made from ceramic.

10. The injection pump of claim 1, further comprising a common rail integrated with the housing (1).

11. The injection pump of claim 1, wherein the pumping stroke of the injection pump is phase-offset in a way synchronized with injection to the instant of injection of the engine.

12. The injection pump of claim 1, wherein the quantity control valve (17) is embodied as a magnet valve that is open when without current.

13. The injection pump of claim 2, wherein the camshaft (7) or the cam disk is part of the engine.

14. The injection pump of claim 1, further comprising an intake throttle regulator regulating the pumping quantity.

* * * * *